US005466080A

United States Patent [19]

Lee

[11] Patent Number: 5,466,080

[45] Date of Patent: Nov. 14, 1995

[54] FINGER PAINTING APPARATUS

[75] Inventor: Sean S. Lee, Hermosa Beach, Calif.

[73] Assignee: Mattel, Inc., El Segundo, Calif.

[21] Appl. No.: 310,543

[22] Filed: Sep. 22, 1994

[51] Int. Cl.[6] ..... B43K 8/02

[52] U.S. Cl. ..... 401/7; 401/8; 401/46; 401/203

[58] Field of Search ..... 401/7, 8, 203, 401/204, 44, 46

[56] References Cited

U.S. PATENT DOCUMENTS

| | | | |
|---|---|---|---|
| 744,455 | 11/1903 | Alwart | 401/8 |
| 774,558 | 11/1904 | Browne . | |
| 859,606 | 7/1907 | Klove . | |
| 1,161,719 | 11/1915 | Norton . | |
| 2,235,350 | 3/1941 | Anderson . | |
| 2,771,224 | 11/1956 | Boerger . | |
| 3,597,099 | 8/1971 | Tollin et al. . | |
| 3,883,897 | 5/1975 | Lefkowitz et al. . | |
| 4,546,922 | 10/1985 | Thametz . | |
| 4,620,528 | 11/1986 | Arraval . | |
| 4,768,681 | 9/1988 | Dean et al. . | |
| 4,869,611 | 9/1989 | Noll . | |
| 4,903,864 | 2/1990 | Sirhan . | |
| 4,911,688 | 3/1990 | Jones . | |
| 5,072,856 | 12/1991 | Kimble . | |
| 5,158,208 | 10/1992 | Wilson . | |
| 5,169,251 | 12/1992 | Davis . | |

*Primary Examiner*—Steven A. Bratlie
*Attorney, Agent, or Firm*—Roy A. Ekstrand

[57] ABSTRACT

A finger painting apparatus includes a housing secured to the backhand portion of a user's hand by a flexible attachment strap. The housing supports a plurality of inverted paint bottles coupled to a corresponding plurality of flexible tubes at one end thereof. The remaining ends of the flexible tubes are coupled to a plurality of pad housings secured to the user's finger tips and supporting a corresponding plurality of porous painting pads on the undersurfaces thereof. The liquid paint material or the like within the inverted paint bottles is caused to flow from the paint bottles through the tubes to the pad housings and thereafter to the porous pads to provide finger painting operation.

6 Claims, 2 Drawing Sheets

10
94
14
11
13
24
23
22
93
92
12
67
68
60
66
65
34
33
32
104
44
54
84
83
53
103
43
52
82
102
42
25
74
73
72

FINGER PAINTING APPARATUS

FIELD OF THE INVENTION

This invention relates generally to finger painting and particularly to apparatus used therein.

BACKGROUND OF THE INVENTION

Finger painting has, for many years, enjoyed great popularity among children in particular as well as others seeking to enjoy artistic and amusement activities. In its simplest form, finger painting or finger art as it is often referred to is carried forward using a plurality of somewhat viscous differently colored paint materials together with a convenient painting surface such as paper sheets or the like. The activity is very straight forward and simple in that the participant simply places some of the viscous paint material upon one or more fingers and thereafter massages it upon the painting surface. While such finger painting activities are extremely enjoyable, they are often equally messy and require cleanup of both the participant's hands and fingers as well as surrounding areas which have become subjected to the paint material. Practitioners in the art have endeavored to provide finger painting apparatus which reduces or renders less arduous the cleanup associated with finger painting activities. Thus, practitioners have provided a variety of finger painting aids. In addition, in a somewhat related arm, practitioners have provided various painting gloves which are utilized for more serious painting efforts and which provide for application of paint to a hand rubbed surface. In another related art, glove apparatus have been provided which provides for dispensing or squirting of liquid materials as the user manipulates one or more digits of the hand.

For example, U.S. Pat. No. 3,597,099 issued to Tollin sets forth a FINGER PAINTING DEVICE having a plurality of cup members bearing paint or marking substances attached to the tip of the user's finger by a finger tip receptacle. The user is then able to stamp or imprint the target surface using the finger tip cap which has been saturated with the paint or other material.

U.S. Pat. No. 3,883,897 issued to Lefkowitz, et al. sets forth a PAINTING GLOVE suitable for wearing upon a painter's hand as a substitute for a paintbrush. The glove consists of a material appropriate for paint application and is fitted with a removable liner therein. A paint reservoir is supported upon the upper surface of the painting glove and is coupled to a plurality of downwardly extending tubes positioned between the digits of the paint glove.

U.S. Pat. No. 5,169,251 issued to Davis sets forth a HAND WORN DISPENSER formed of a thin walled protective glove having a self-contained palm receptacle for storing various materials to be dispensed from the receptacle in response to the wearer's compressing or agitating. The receptacle includes outwardly extending conduits supported proximate each finger and thumb of the glove and coupled to the palm reservoir.

U.S. Pat. No. 5,072,856 issued to Kimble sets forth a TOY WEB SHOOTING GLOVE having a glove apparatus coupled to a can of string foam material by a flexible conduit. The flexible conduit terminates at the glove palm and includes a trigger mechanism for dispensing the web material.

U.S. Pat. No. 5,158,208 issued to Wilson sets forth a WATER CANNON APPARATUS having a fluid storage tank and torso belt for support thereof together with a glove member worn upon the user's hand. A fluid conduit is coupled between the storage tank and the glove together with a trigger mechanism supported within the glove.

U.S. Pat. No. 2,771,224 issued to Boerger sets forth a HAND CARRIED LIQUID DISPENSER having a liquid reservoir defining a projecting nozzle and having means for securing the reservoir to the outer surface of the wearer's hand such that the nozzle extends between the wearer's fingers. A trigger mechanism operates as the user manipulates his or her hand to dispense the liquid material through the nozzle.

U.S. Pat. No. 2,235,350 issued to Anderson sets forth a LOTION DISPENSER having a bracelet-like housing receivable upon the user's wrist and defining an interior cavity therein. The interior cavity receives lotion which is dispensed through a dispensing aperture in the housing.

U.S. Pat. No. 1,161,719 issued to Norton sets forth a MASSAGE GLOVE having a plurality of liquid filled cavities at the distal points for each digit. The liquid filled cavities define apertures for slowly dispensing liquid therefrom as the user massages a surface.

U.S. Pat. No. 4,903,864 issued to Sirhan sets forth a GLOVE AMUSEMENT DEVICE including a liquid storage apparatus, a glove and an umbilical cord connecting the two. The storage apparatus includes a battery powered pump and a trigger mechanism on the glove controls the flow of liquid through the umbilical member.

U.S. Pat. No. 4,768,681 issued to Dean, et al. sets forth a FLUID ACTION TOY WORN BY USER having a glove supporting a water housing on the outer surface thereof together with a battery powered pump. A pair of actuators are mounted on the thumb sheath and the forefinger sheath of the glove which when brought together cause the pump mechanism and operate and squirt the liquid.

U.S. Pat. No. 4,546,922 issued to Thometz sets forth a MULTICOLORED AIRBRUSH ATTACHMENT SYSTEM HAVING A SPIRAL MIXING CHAMBER AND A WRIST/ARM-MOUNTED PAINT RESERVOIR in which an air brush is provided with a mixing chamber and a plurality of paint conduits to provide paint color mixing during spraying.

U.S. Pat. No. 4,620,528 issued to Arraval sets forth a FINGER OPERATED DENTAL CARE IMPLEMENT having a finger supported toothbrush and a palm held bulb filled with dental hygiene material such as toothpaste together with a conduit therebetween.

U.S. Pat. No. 4,869,611 issued to Noll sets forth a BINGO CARD MARKER having a ink nib supported upon the user's finger and a pressure responsive valve coupled thereto together with a flexible conduit extending from the valve to a wrist supported ink reservoir.

U.S. Pat. No. 4,911,688 issued to Jones sets forth a FLUID CONTAINING COVERS WITH ELECTRICAL CIRCUITS having fluid chambers securable to a patient's outer skin and having one or more electrical connections to an external electrical apparatus.

U.S. Pat. No. 859,606 issued to Klove sets forth a MOISTENING DEVICE having a liquid dabber securable to a ring worn upon the user's finger.

U.S. Pat. No. 774,558 issued to Browne sets forth a MOISTENER FOR GUMMED SURFACES having a liquid reservoir securable to the wearer's hand and a finger tip element together with a conduit coupling therebetween.

While the foregoing described prior art devices have provided improvements in their various arts, there remains nonetheless a continuing need in the art for evermore improved, interesting and entertaining finger painting apparatus.

SUMMARY OF THE INVENTION

Accordingly, it is a general object of the present invention to provide an improved finger painting apparatus. It is a more particular object of the present invention to provide an improved finger painting apparatus which avoids the need to periodically replenish the supply of finger painting material during use.

In accordance with the present invention, there is provided a finger painting apparatus comprises: a housing having a plurality of paint bottle receptacles formed thereon; attachment means for securing the housing to a user's hand; a plurality of pad housings each having finger tip attachment means, coupling means, and an undersurface; a plurality of porous pads supported upon the undersurfaces; a plurality of paint bottles each having interior cavities for receiving a liquid and each having an open end; a plurality of nozzles each coupled to the open ends of the paint bottles; and a plurality of flexible tubes each having one end coupled to one of the nozzles and another end coupled to one of the coupling means of the pad housings.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
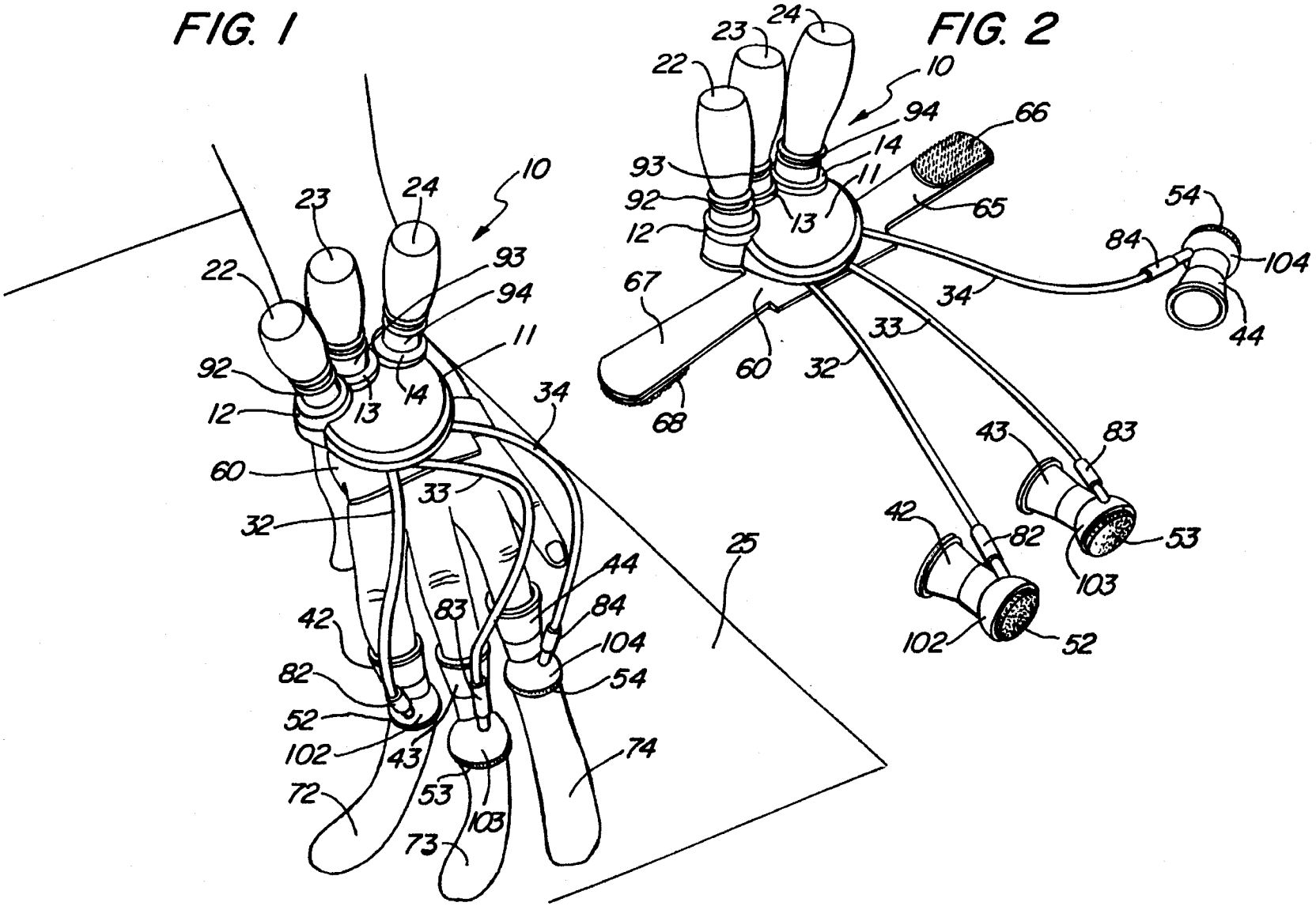
FIG. 1 sets forth a perspective view of a finger painting apparatus constructed in accordance with the present invention worn upon the hand of a typical user.
FIG. 2 sets forth a perspective view of the present invention finger painting apparatus.

FIG. 1 sets forth a perspective view of a finger painting apparatus constructed in accordance with the present invention and generally referenced by numeral 10. Apparatus 10 includes a housing 11 supporting a plurality of receptacles 12, 13 and 14. Apparatus 10 further includes a flexible support strap 60 which as is better seen in FIG. 2 includes a pair of outwardly extending flexible ends 65 and 67 having attachment pads 66 and 68 secured thereto. Returning to FIG. 1, support strap 60 is shown wrapped about the backhand portion of a typical user's hand. Apparatus 10 further includes a plurality of paint bottles 22, 23 and 24 received within a corresponding plurality of collars 92, 93 and 94 and secured to receptacles 12, 13 and 14 respectively in the manner shown in FIG. 4. A plurality of flexible tubes 32, 33 and 34 are coupled at one end to bottles 22, 23 and 24 respectively in the manner also shown in FIGS. 3 and 4. Apparatus 10 further includes a plurality of finger caps 42, 43 and 44 received upon a selected three fingers of the user's hand. A plurality of pad housings 102, 103 and 104 are secured to finger caps 42, 43 and 44 respectively and support a corresponding plurality of porous pads 52, 53 and 54 respectively. A plurality of couplings 82, 83 and 84 extend upwardly from pad housing 102, 103 and 104 and are coupled to the remaining ends of tubes 32, 33 and 34 respectively.

In operation, a paper sheet 25 or other suitable medium is positioned for use in the finger painting activity using apparatus 10. In addition, quantities of colored paint are received within paint bottles 22, 23 and 24. By means set forth below in greater detail, the inverted support of bottles 22, 23 and 24 causes the liquid paint material therein to flow downwardly through flexible tubes 32, 33 and 34 through couplings 82, 83 and 84 to eventually saturate pads 52 through 54 respectively. In addition, the flow of liquid from bottles 22 through 24 to pads 52 through 54 may be increased or facilitated by squeezing bottles 22 through 24 which in their preferred form are fabricated of a resilient plastic material or the like.

Once pads 52 through 54 are saturated with the paint material from their respective paint bottles, the user then manipulates pads 52 through 54 upon paper sheet 25 to create different colored image elements 72 through 74 by moving pads 52 through 54 upon the paper sheet. It will be apparent to those skilled in the art that the user may utilize all manner of finger tip manipulation to achieve the particular results desired in finger painting upon paper sheet 25. In accordance with an important aspect of the present invention, the individual paint quantities within bottles 22 through 24 are coupled to pads 52 through 54 without subjecting the user's fingers to immersion or contact with the paint material. This, of course, is advantageous in avoiding the above-described cleanup problems normally associated with finger painting. In addition, unlike finger painting apparatus which must be periodically saturated to renew the supply of finger paint material, the quantity of material within paint bottles 22 through 24 provides a continuing long term supply of paint material avoiding this interruption of the finger painting process. The support of bottles 22 through 24 upon the user's hand maintains the paint supply conveniently while permitting complete freedom of motion of the user's hand without restriction upon the paper sheet. It will be apparent to those skilled in the art that while the embodiment shown in FIGS. 1 through 4 set forth apparatus utilizing three paint bottles and three finger pads, a different number of paint bottles and finger pads may be utilized without departing from the spirit and scope of the present invention.

FIG. 2 sets forth a perspective view of the present invention finger painting apparatus removed from the user's hand. As described above, apparatus 10 includes a housing 11 supporting a plurality of receptacles 12 through 14 which in turn receive a plurality of collars 92 through 94 coupling a plurality of paint bottles 22 through 24 respectively to housing 11. A plurality of flexible tubes 32 through 34 are coupled at one end to paint bottles 22 through 24 respectively in the manner shown in FIGS. 3 and 4 and coupled at their remaining ends to a plurality of pad housings 102 through 104 using couplers 82 through 84 respectively. A plurality of porous pads 52 through 54 are secured to the undersurfaces of pad housings 102 through 104 respectively. A plurality of finger caps 42 through 44 are secured to the upper portions of pad housings 102 through 104 respectively.

Finger painting apparatus 10 further includes a flexible support strap 60 having flexible strap ends 65 and 67 supporting fabric attachment pads 66 and 68 respectively. While virtually any attachment mechanism may be used to secure strap support 60 to the user's hand, it has been found convenient to utilize attachment pads 66 and 68 formed of cooperating hook and loop fabric attachment elements. In its preferred form, apparatus 10 is fabricated largely of washable plastic material such as molded plastic material or the like. However, it will be recognized that a variety of materials may be used to fabricate the present invention finger painting apparatus.

Figure 3:
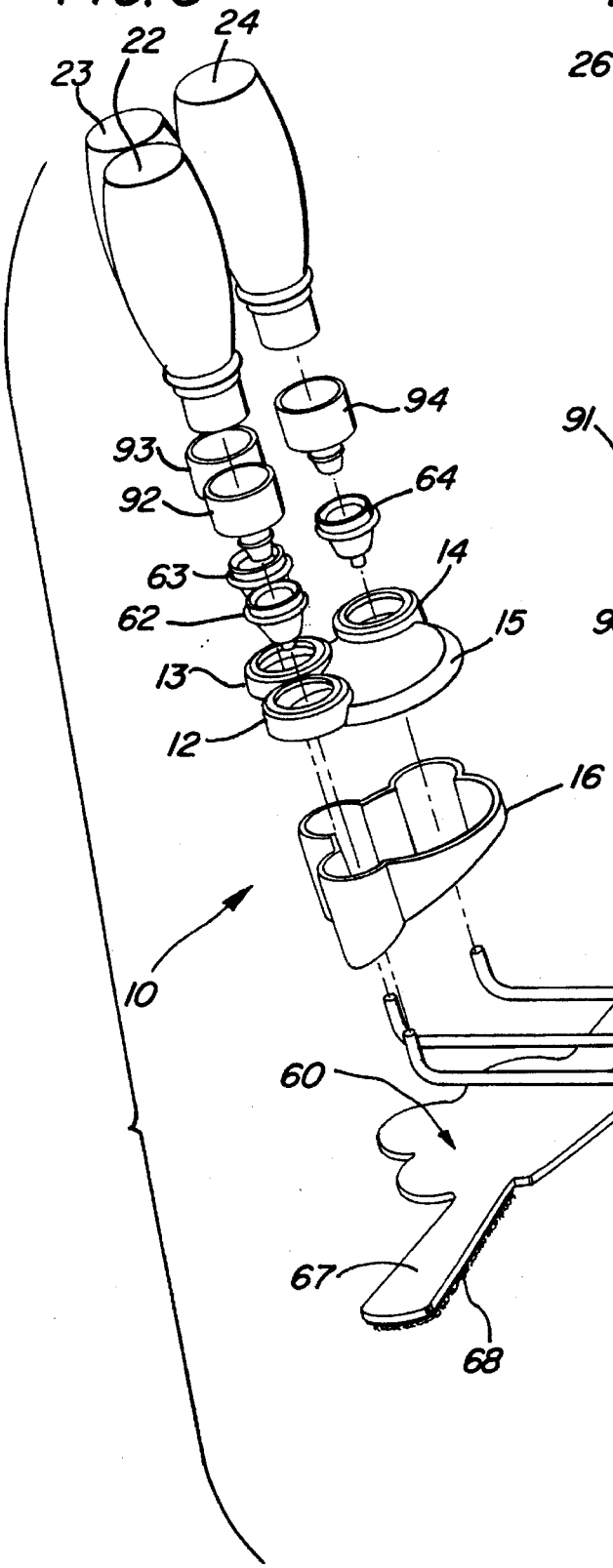
FIG. 3 sets forth a perspective assembly view of the present invention finger painting apparatus.

FIG. 3 sets forth a perspective assembly view of the present invention finger painting apparatus. Finger painting apparatus 10 includes a flexible support strap 60 having strap ends 65 and 67 extending outwardly and supporting a pair of fabric attachment pads 66 and 68 respectively. An upper housing 15 and a lower housing 16 combine to form housing 11 described above. Upper housing 15 further defines a plurality of receptacles 12 through 14 having apertures formed therein. Receptacles 12 through 14 receive a plurality of nozzles 62 through 64 respectively which in their preferred form are assembled from the underside of upper housing 15. A plurality of cylindrical collars 92 through 94 are received within receptacles 12 through 14 respectively and are coupled to nozzles 62 through 64. A plurality of inverted paint bottles 22 through 24 are received within collars 92 through 94 in a liquid sealed attachment. A plurality of flexible tubes 32 through 34 extend upwardly through lower housing 16 and are respectively coupled to nozzles 62 through 64. The remaining ends of tubes 32 through 34 extend outwardly from lower housing 16 and are received within a plurality of couplings 82 through 84.

A plurality of pad housings 102 through 104 support couplings 82 through 84 and receive a plurality of finger caps 42 through 44 respectively. A plurality of porous pads 52 through 54 are secured to the undersurfaces of pad housings 102 through 104.

Figure 4:
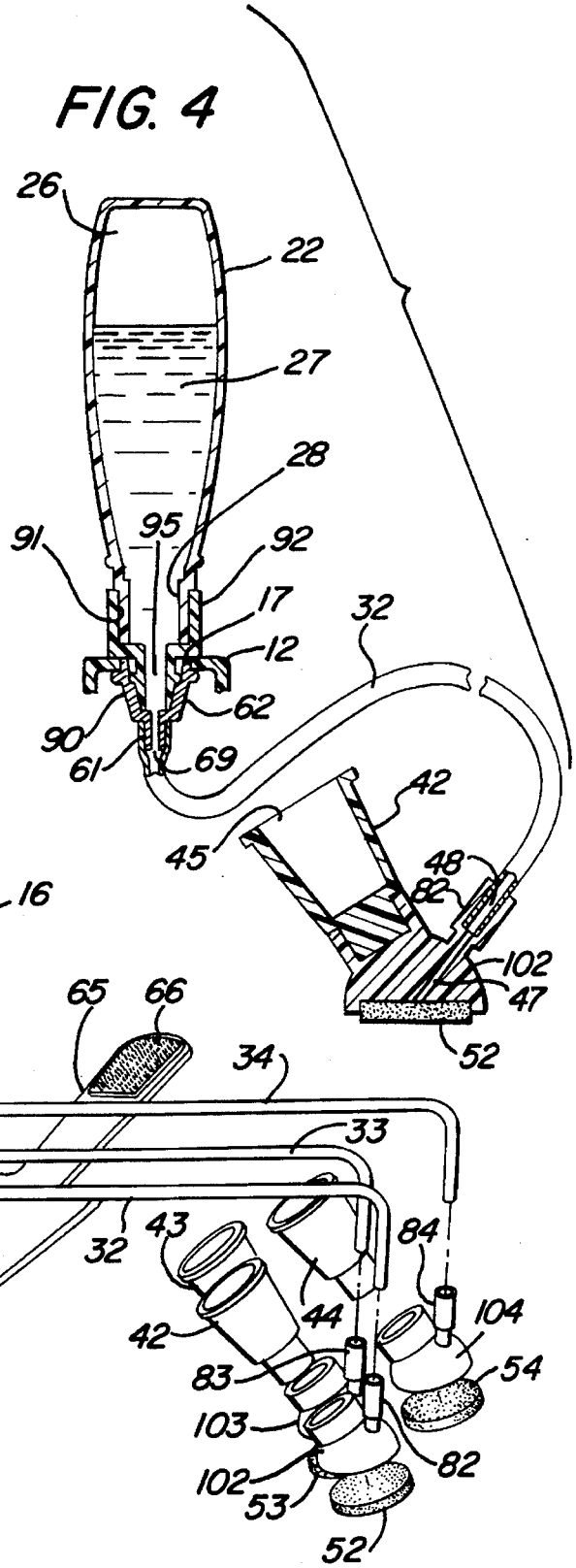
FIG. 4 sets forth a section view of the present invention finger painting apparatus.

FIG. 4 sets forth a section view of paint bottle 22, collar 92, nozzle 62, receptacle 12, tube 32, pad housing 102, pad 52 and finger cup 42 to illustrate the coupling path of paint or other liquid from within the paint bottles of the present invention apparatus to their respective porous pads. It will be understood that bottles 23 and 24 utilize an identical coupling mechanism via tubes 33 and 34 to pads 53 and 54 and thus the illustration of FIG. 4 and the descriptions which accompany it should be understood to apply well thereto.

More specifically, paint bottle 22 defines an interior cavity 26 supporting a quantity of liquid 27 such as paint or the like. Bottle 22 defines a cylindrical end portion 28 extending downwardly. A cylindrical collar 92 defines a bore 91 receiving end 28 in a liquid seal attachment. Receptacle 12 of upper housing 15 (seen in FIG. 3) defines an aperture 17 through which a tapered tip 90 formed at the lower portion of collar 92 extends. Tip 90 defines a center passage 95 in communication with interior cavity 26. A tapered nozzle 62 having a tip 61 defining a passage 69 therethrough is received beneath receptacle 12 and coupled to the downwardly extending portion of tip 90 to secure nozzle 62 to collar 92 and captivate receptacle 12 therebetween. To assist in disassembly for cleaning purposes, it has been found convenient to secure nozzle 62 to tip 90 of collar 92 using a snap-fit attachment. However, conventional adhesive attachment may be utilized if desired.

A pad housing 102 supports a porous pad 52 on the undersurface thereof and an upwardly extending coupling 82. Coupling 82 defines a passage 48 which receives one end of a flexible plastic tube 32. Tube 32 is hollow and is secured to coupling 82 using snap-fit attachment or, alternatively, adhesive attachment or other similar attachment means. Pad housing 102 defines a passage 47 communicating passage 48 of coupling 82 to pad 52. A finger cup 42 defines a recess 45 and is secured to pad housing 102 using adhesive attachment or other conventional attachment means. The remaining end of flexible tube 32 is received upon tip 61 of nozzle 62 to complete the coupling of pad 52 to interior cavity 26 of paint bottle 22.

In operation, liquid 27 within interior cavity 26 flows downwardly through passage 95 of collar 92 and passage 69 of tip 61 and thereafter through hollow tube 32 to enter passage 47 of pad housing 102. Pad 52 absorbs the liquid flowing through passage 47 to saturate pad 52 for the finger painting operation described above. The size of passage 47 is selected with respect to the viscosity of liquid 27 to provide the desired flow characteristic and maintain the saturation of pad 52. In addition, bottle 22 is preferably formed of a resilient plastic material and thus the user may squeeze bottle 22 if necessary to increase the liquid flow to pad 52. The porosity of pad 52 which may be formed of a foam plastic material or the like is selected to maintain a substantial quantity of liquid avoiding leaking or excessive flow of the liquid material.

As mentioned above, it will be understood that the descriptions of FIG. 4 apply equally well to the fluid paths of bottles 23 and 24 to porous pads 53 and 54. It will be equally well understood by those skilled in the art that while a trio of paint bottles is shown in FIGS. 1 through 3, different numbers of paint bottles may be utilized without departing from the spirit and scope of the present invention. It will be further understood that while the primary use of the present invention finger painting apparatus is directed to a liquid paint material, other colored materials such as colored ink or the like may be utilized without departing from the spirit and scope of the present invention.

What has been shown is a finger painting apparatus which provides a convenient source of liquid paint supported upon the user's hand and coupled to a plurality of porous pads supported upon finger caps secured to the user's finger tips. The apparatus provided avoids direct contact between the user's fingers and the paint material while also avoiding restriction of the user's hand movements during the painting activities.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A finger painting apparatus comprising:

a housing having a plurality of paint bottle receptacles formed thereon;

attachment means for securing said housing to a user's hand;

a plurality of pad housings each having finger tip attachment means, coupling means, and an undersurface;

a plurality of porous pads supported upon said undersurfaces;

a plurality of paint bottles each having interior cavities for receiving a liquid and each having an open end;

a plurality of nozzles each coupled to said open ends of said paint bottles; and a plurality of flexible tubes each having one end coupled to one of said nozzles and another end coupled to one of said coupling means of said pad housings.

2. A finger painting apparatus as set forth in claim 1 wherein said paint bottles are formed of a resilient plastic material.

3. A finger painting apparatus as set forth in claim 2 wherein said housing supports said paint bottles in a generally perpendicular relationship to a user's backhand when said apparatus is secured to a user's hand.

4. A finger painting apparatus as set forth in claim 3 wherein said attachment means includes a flexible strap secured to said housing and having flexible ends each supporting a fabric attachment pad.

5. A finger painting apparatus as set forth in claim 4 wherein each of said pad housings define a passage forming the smallest area portion of liquid flow from said bottles to said pads for communicating liquid to said pads at a limited flow rate.

6. A finger painting apparatus as set forth in claim 5 wherein said coupling means extend forwardly and upwardly from said pad housings and wherein said finger tip attachment means include finger caps having finger tip receiving recesses extending upwardly and rearwardly from said pad housings.

* * * * *